US007077907B2

(12) United States Patent
Tomaru

(10) Patent No.: US 7,077,907 B2
(45) Date of Patent: Jul. 18, 2006

(54) COATING HEAD AND COATING APPARATUS

(75) Inventor: Mikio Tomaru, Odawara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/940,809

(22) Filed: Sep. 15, 2004

(65) Prior Publication Data

US 2005/0056214 A1 Mar. 17, 2005

(30) Foreign Application Priority Data

Sep. 17, 2003 (JP) ..... 2003-325170

(51) Int. Cl.
*B05C 3/02* (2006.01)

(52) U.S. Cl. ..... 118/410; 118/419

(58) Field of Classification Search ..... 118/410, 118/419, 411, 325; 427/356
See application file for complete search history.

(56) References Cited

U.S. PATENT DOCUMENTS

| | | | | |
|---|---|---|---|---|
| 4,681,062 A | | 7/1987 | Shibata et al. | |
| 4,854,262 A | | 8/1989 | Chino et al. | |
| 5,119,757 A | * | 6/1992 | Chino et al. | 118/410 |
| 5,397,600 A | | 3/1995 | Shibata et al. | |
| 5,484,629 A | * | 1/1996 | Ghosh et al. | 427/255.21 |
| 5,547,510 A | * | 8/1996 | Aizawa et al. | 118/410 |

FOREIGN PATENT DOCUMENTS

| | | |
|---|---|---|
| JP | 60-238179 A | 11/1985 |
| JP | 63-088080 A | 4/1988 |
| JP | 5-8065 B2 | 2/1993 |
| JP | 06-134380 A | 5/1994 |
| JP | 6-77712 B2 | 10/1994 |
| JP | 2942938 B2 | 6/1999 |
| JP | 2000-343019 A | 12/2000 |

* cited by examiner

*Primary Examiner*—Brenda A. Lamb
(74) *Attorney, Agent, or Firm*—Sughrue Mion, PLLC

(57) ABSTRACT

The coating head according to the present invention comprises a slit facing the supporting member along a width direction of the supporting member, the coating fluid being ejected through an opening of the slit, a front edge surface provided on an upstream side of the slit in a direction of travel of the supporting member, the front edge surface facing the supporting member, a back edge surface provided on a downstream side of the slit in the direction of travel of the supporting member, the back edge surface facing the supporting member, and a back edge back surface intersecting the back edge surface by forming a predetermined angle therebetween, wherein a surface roughness Ra of the back edge back surface is 0.2 μm or less.

5 Claims, 4 Drawing Sheets

| | BACK EDGE BACK SURFACE Ra[μm] | SMOOTH PORTION LENGTH [mm] | GENERATION OF FINE RIB STREAKS |
|---|---|---|---|
| CONDITION1 | 0.7 | 1.0 | GENERATED |
| CONDITION2 | 0.4 | 1.0 | GENERATED |
| CONDITION3 | 0.2 | 1.0 | NOT GENERATED |
| CONDITION4 | 0.2 | 0.5 | NOT GENERATED |
| CONDITION5 | 0.2 | 0.3 | GENERATED |
| CONDITION6 | 0.1 | 0.5 | NOT GENERATED |
| CONDITION7 | 0.1 | 0.3 | GENERATED |

FIG.7

| | BACK EDGE BACK SURFACE Ra [μm] | SMOOTH PORTION LENGTH [mm] | LOWER LAYER WET THICKNESS [μm] | UPPER LAYER WET THICKNESS [μm] | GENERATION OF FINE RIB STREAKS |
|---|---|---|---|---|---|
| CONDITION8 | 0.7 | 1.0 | 6.0 | 1.2 | GENERATED |
| CONDITION9 | 0.4 | 1.0 | 6.0 | 1.2 | GENERATED |
| CONDITION10 | 0.2 | 1.0 | 6.0 | 1.2 | NOT GENERATED |
| CONDITION11 | 0.2 | 0.5 | 6.0 | 1.2 | NOT GENERATED |
| CONDITION12 | 0.2 | 0.3 | 6.0 | 1.2 | GENERATED |
| CONDITION13 | 0.1 | 0.5 | 6.0 | 1.2 | NOT GENERATED |
| CONDITION14 | 0.1 | 0.3 | 6.0 | 1.2 | GENERATED |

COATING HEAD AND COATING APPARATUS

BACKGROUND OF THE INVENTION

1. Field of the Invention

The present invention relates to a coating head and a coating apparatus and, more particularly, to a coating head and a coating apparatus suitable for forming a coating film such as a magnetic recording layer on a flexible supporting member traveling while being supported by travel guide devices such as guide rollers.

2. Description of the Related Art

Conventional methods for forming a coating film on a flexible supporting member traveling continuously while being supported by travel guide devices such as guide rollers include application-type methods such as roller coating, dip coating and fountain coating, and measuring-type methods such as air-knife coating, blade coating and bar coating. As methods using a combination of an application-type method and a measuring-type method in one place, extrusion coating, slide bead coating, curtain coating and so on have been used.

Extrusion coating among such methods is suitable for forming a thin film, a multilayer film or the like and has been introduced for manufacture of magnetic recording mediums, particularly magnetic tapes because the productivity (coating speed) when extrusion coating is used is high. The applicant of the present invention has made various improvements and propositions relating to this kind of coating in documents including those shown below and has achieved certain effects.

Japanese Examined Application Publication No. 5-8065 relates to a method of extrusion coating of one layer and an improvement in the shape of a coating head, Japanese Examined Application Publication No. 6-77712 relates to a method of extrusion coating of a plurality of layers and an improvement in the shape of a coating head, particularly a specified end radius of curvature, Patent Publication No. 2942938 relates to a method of extrusion coating of a plurality of layers in which two-layer coating is performed with a coating head after precoating, and Japanese Patent Application Publication No. 2000-343019 relates to an extrusion application method in which the surface roughness of a coating head is improved to improve a coating condition.

SUMMARY OF THE INVENTION

The above-described extrusion application methods, however, entail a specific problem that a fine streak defect sometimes occur in coating film. This streak defect is fine streaks locally formed with a constant pitch of several hundred microns. There is a possibility of a reduction in product quality resulting from this defect. Under present circumstances, this problem cannot be completely solved by any of the methods described in the publications Nos. 5-8065, 6-77712 and 2942938.

As a measure against this problem, an improvement is made in a coating apparatus, for example, as described in Japanese Patent Application Publication No. 2000-343019. Even in a case where such an apparatus, for example, one arranged to set the surface roughness Ra of a predetermined portion to 5 μm or less and 0.7 μm at the minimum is used, fine streaks appear with a constant pitch of several hundred microns when thin-coating coating is performed by setting a coating thickness to 10 μm or less in a wet condition, and the effect is not satisfactory.

In view of the above-described circumstances, an object of the present invention is to provide a coating head and a coating apparatus capable of forming a thin film at a high speed and free from occurrence of fine equal-pitch streaks.

To achieve the above-described object, according to the present invention, there is provided a coating head used in a coating apparatus which applies a coating fluid to a surface of a flexible supporting member in a form of a belt traveling continuously, the coating head having a slit facing the supporting member along a width direction of the supporting member, the coating fluid being ejected through an opening of the slit, a front edge surface provided on an upstream side of the slit in the direction of travel of the supporting member, the front edge surface facing the supporting member, a back edge surface provided on a downstream side of the slit in a direction of travel of the supporting member, the back edge surface facing the supporting member, and a back edge back surface intersecting the back edge surface by forming a predetermined angle therebetween, wherein a surface roughness Ra of the back edge back surface is 0.2 μm or less.

According to the present invention, the coating fluid between the surface of the flexible supporting member and the back edge surface moves apart from the predetermined position at which the back edge back surfaces intersects the back edge surface by forming the predetermined angle therebetween. Therefore, if the surface roughness of is made smooth, more specifically, if the surface roughness Ra is set to 0.2 μm or less, disturbance in the coating film is effectively reduced and substantially no fine equal-pitch streaks are generated.

The surface roughness Ra is measured as the arithmetic mean source roughness Ra specified in JIS (Japanese Industrial Standard) B 0601.

According to the present invention, it is preferred that a recess extending along the width direction of the supporting member is formed in the back edge back surface. It is preferable to perform grinding as surface finishing on the back edge back surface. If such a recess extending along the width direction of the supporting member is formed, a grinding wheel used for grinding does not interfere with any portion other than the worked surface and, therefore, the finished condition of the worked portion of the back edge back surface is good. The present invention is effective in this respect.

According to the present invention, it is preferred that the surface roughness Ra of the portion of the back edge back surface between the position at which the back edge back surface intersects the back edge surface and a position at a distance of 0.5 mm from the intersecting position is 0.2 μm or less. By defining the portion having a suitable surface roughness at least by this distance, full use of the effect of the present invention can be made.

According to the present invention, it is also preferred that the distance between the position at which the back edge back surface intersects the back edge surface and the recess is 0.5 mm or greater. By defining the portion having a suitable surface roughness at least by this distance, full use of the effect of the present invention can be made.

According to the present invention, it is also preferred that each of the back edge surface and the back edge back surface is formed by a sintered hard alloy or a ceramic. By using such a material for the back edge surface and the back edge back surface, the surface roughness after working can be improve to make full use of the effect of the present invention.

According to the present invention, as described above, the coating head has a slit, a front edge surface, a back edge surface and a back edge back surface intersecting the back edge surface by forming a predetermined angle therebetween, and the surface roughness Ra of the back edge back surface is 0.2 μm or less. This arrangement ensures that disturbance in the coating film is effectively reduced and substantially no fine equal-pitch streaks are generated.

BRIEF DESCRIPTION OF THE DRAWINGS

FIG. 7 is a table showing the results of Example 2.

DETAILED DESCRIPTION OF THE PREFERRED EMBODIMENTS

Figure 1:
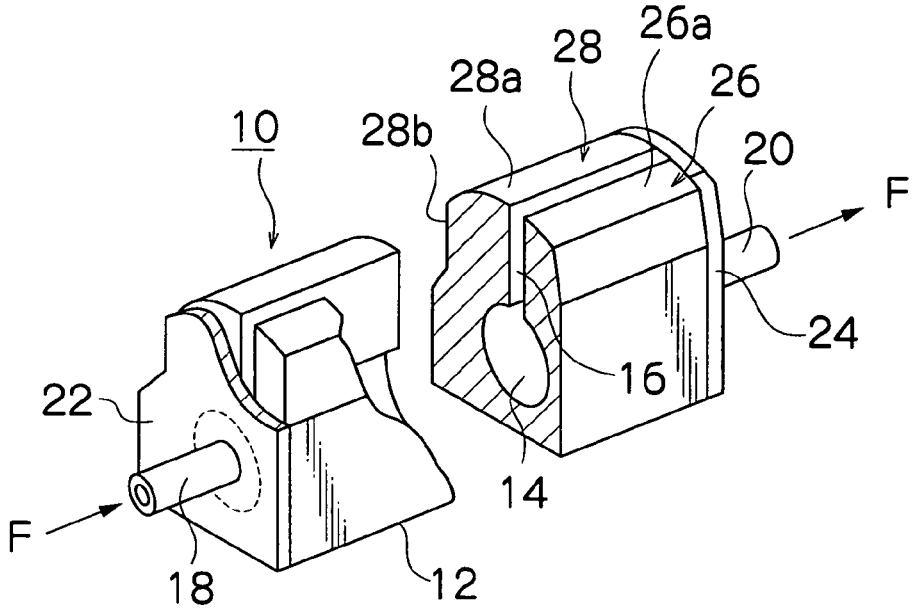
FIG. 1 is a partially-cutaway perspective view of a coating head in a coating apparatus in accordance with the present invention.
Figure 2:
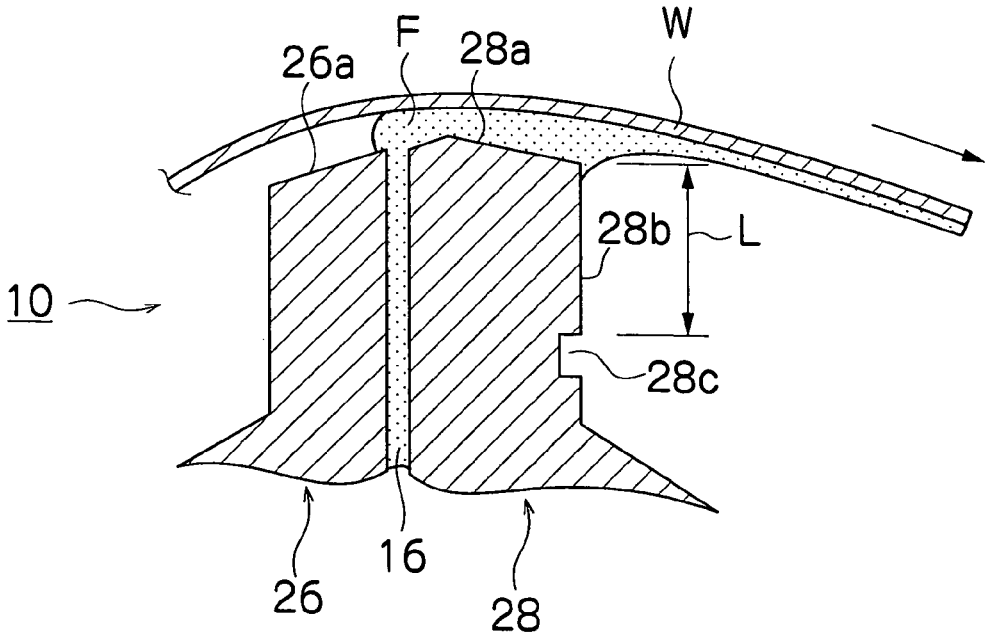
FIG. 2 is a schematic cross-sectional view of the coating head showing the positional relationship between an end portion of the coating head and a flexible supporting member.

An embodiment of the present invention will be described with reference to the accompanying drawings. FIG. 1 is a partially-cutaway perspective view of a coating head 10 in a coating apparatus in accordance with the present invention. FIG. 2 is a schematic cross-sectional view of the coating head 10 showing the positional relationship between an end portion of the coating head 10 and a flexible supporting member (hereinafter referred to as "web") W in a state where the web W is set on the coating head 10 and a coating fluid is applied to the web W.

As shown in FIGS. 1 and 2, the coating head 10 is provided with a fluid supply system capable of supplying a coating fluid, as described below. In the main body 12 of the coating head 10 are provided a sump 14 extending in the longitudinal direction (the width direction of the web W), a slit 16 communicating with the sump 14 and having an opening which faces the web W along the longitudinal direction (web W width direction) and through which the coating fluid is ejected, a fluid supply port 18 through which the coating fluid is supplied to the sump 14, and a fluid drain 20 through which the coating fluid is drawn out from the sump 14.

The sump 14 is also referred to as a "pocket" or a "manifold". The sump 14 is a cavity having a generally circular cross section, elongated along the web W width direction so as to be uniform in its cross-sectional shape, and having a fluid storing function. The effective length of the sump 14 is ordinarily set to a value equal to or slightly larger than the coating width. Opposite-end openings of the sump 14 between which the sump 14 is formed through the main body 12 are closed by closing plates 22 and 24 attached to opposite-end portions of the main body 12, as shown in FIG. 1. The above-described fluid supply portion 18 and fluid drain 20 are provided on the closing plates 22 and 24, respectively.

The slit 16 is a comparatively narrow flow path which is formed through the main body 12 from the sump 14 toward the end of the main body 12 facing the web W, with the opening width ordinarily set to 0.01 to 0.5 mm, and which extends along the web W width direction, as does the sump 14. The opening width of the slit 16 along the web W width direction is set to a value approximately equal to the coating width. The length of the flow path in the slit 16 in the direction toward the web W is selected as desired by considering various conditions including the composition and physical properties of the coating fluid, the supply flow rate and the supplied fluid pressure. That is, the length of the flow path may be set to such a value that the coating fluid can be supplied in laminar flow form from the slit 16 and the flow rate and the fluid pressure distribution are uniform along the web W width direction.

The end portion of the coating head 10 will be described with reference to FIG. 2. The slit 16 is formed by a front edge 26 and a back edge 28 of the main body 12 of the coating head 10 (see FIG. 1). In the upper surface of the main body 12 of the coating head 10 (the surface facing the web W), a front edge surface **26*a* and a back edge surface 28*a* are formed, the front edge surface 26*a* being located on the upstream side. A back edge surface 28*b* intersecting the back edge surface 28*a* at a certain angle is also formed. Further, a recess 28*c* extending along the web W width direction (the direction of projection of FIG. 2) is formed at a distance L from the intersection (edge) between the back edge surface 28*a* and the back edge surface 28*b***.

As shown in FIG. 2, the front edge surface **26*a* is formed so as be straight as viewed in section, while the back edge surface 28*a* is formed so as to form a peak as viewed in section. Also, a certain difference in level is provided between the rear edge of the front edge surface 26*a* and the front edge of the back edge surface 28*a*** to form a film of coating fluid F having a predetermined thickness.

The shapes of the front edge surface **26*a* and the back edge surface 28*a* shown in FIG. 2 is only and example, and any of various shapes, e.g., a circular-arc shape and a parabolic shape may be used as the shape of the front or back edge surface 26*a* or 28*a*. Also, the predetermined angle between the back edge surface 28*a* and back edge surface 28*b* in the configuration shown in FIG. 2 is only an example, and the back edge surface 28*a* and the back edge surface 28*b* may form an angle larger or smaller than that shown in FIG. 2**.

Description will next be made of a method of working the coating head 10, particularly the main body 12. A material which does not contaminate and denature the coating fluid F, which has a mechanical strength higher than a predetermined value, and which can be easily worked is preferred as a material forming the coating head 10. Such a material may be selected from various metallic materials (stainless steel, brass, etc.). Selection may also be made from inorganic materials such as easily workable ceramics and engineering plastics according to use. The main body 12 may be formed of a plurality of materials. A sintered hard alloy or a ceramic for example may be inlayed by being fixed by a mechanical fixing device or bonding in a portion which needs to have certain properties including a surface roughness.

A method of working the main body 12 may be selected from various working methods such as cutting, grinding and electrical discharge machining according to the material of the main body 12. Among such various methods, cutting or grinding using abrasive grains or the like is preferred particularly for working on the front edge surface 26*a*, the back edge surface 28*a* and the back edge surface 28*b*, where a certain surface roughness is required. In the description of this embodiment, grinding of the back edge surface 28*b* using a cut wheel (straight cup wheel) will be described.

Figure 3:
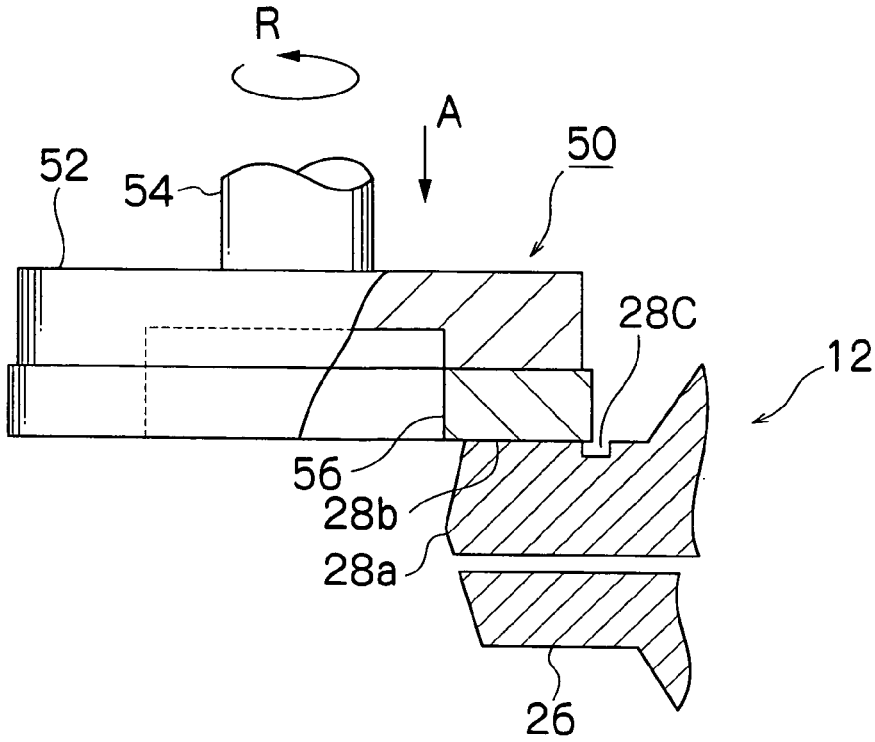
FIG. 3 is a schematic cross-sectional view showing the positional relationship between a back edge surface of the coating head and a grinding wheel.

FIG. 3 is a schematic cross-sectional view showing the positional relationship between the back edge surface 28*b* of the coating head 10 and a grinding wheel portion (cup wheel) 50. The grinding wheel portion 50 is constituted by a base 52 in the form of a cup, a rotating shaft 54 extending from central portion of the base 52, and a grinding portion 56 in the form of a ring extending from an end of the base 52. The grinding portion is a bond grinding wheel formed of a superabrasive such as diamond (synthetic diamond) or cBN (cubic boron nitride). In the case of a grinding wheel 50 used for finishing, the grinding wheel portion 50 is preferably a metal bond wheel having a superabrasive of several thousands to ten and several thousands in # number in JIS (Big # number indicates that abrasive grains are very fine). By working with such grinding wheel 50, the surface roughness Ra of the worked surface (back edge surface 28*b*) can be set to 0.2 μm or less.

The recess 28*c* extending along the web W width direction is formed at the distance L (see FIG. 2) from the intersecting point (edge) at which the back edge surface 28*b* intersects the back edge surface 28*a*. When grinding is performed, the outer circumferential edge of the grinding wheel 50 is positioned on the thus-formed recess 28*c*, as shown in FIG. 3. Thus, the working surface of the grinding wheel 50 covers the entire back edge surface 28*b* to be worked, which is preferable in improving the surface roughness of the worked surface. That is, if the working surface of the grinding wheel 50 contacts a portion of the main body 12 other than the portion to be worked, there is a possibility of vibration, surface wobbling or the like of the grinding wheel 50 due to the influence of contact with the portion other than the portion to be worked, resulting in degradation in the finished condition of the worked surface. However, if the recess 28*c* exists, such a fault does not occur.

It is preferable to set the distance L shown in FIG. 2 to 0.5 mm or more in order to make full use of the effect of the recess 28*c*, reduce disturbance in the coating film and reduce fine equal-pitch streaks. If the distance L is smaller than 0.5 mm, and if the viscosity of the coating fluid F is low, there is a possibility of the fluid contact area reaching the recess 28*c*, which is undesirable.

Flat surface grinding with a surface grinder (a horizontal-axis-angle table type of surface grinder, in particular) and a surface grinding wheel (1H1 type grinding wheel or the like) may be used as well the working method using the illustrated grinding wheel (cup wheel) 50.

Description will next be made of the flexible supporting member (web) W used in the present invention. As the web W, a resin film, paper (resin coated paper, synthetic paper or the like), metal foil (aluminum web or the like) or the like can be used. As the material of a resin film used as the web W, any of well-known materials such as polyethylene, polypropylene, polyvinyl chloride, polystyrene, polyamide, PET (polyethylene terephthalate), biaxially stretched polyethylene terephthalate, polyethylene naphthalate, polyamideimide, aromatic polyamide, cellulose triacetate and cellulose diacetate can be used. Among these materials, polyethylene terephthalate, polyethylene naphthalate and polyamide are particularly preferable.

The web W formed of such a material may undergo corona discharge, a plasma treatment, a treatment for facilitating bonding, a heat treatment, a dust removal treatment or the like in advance. The surface roughness Ra of the web W is preferably 3 to 10 nm at a cutoff value of 0.25 mm.

The operation of the coating apparatus will now be described mainly through the description of the operation of the coating head 10. As shown in FIG. 1, the coating fluid F is supplied to the sump 14 via the fluid supply port 18 by a metering fluid feed device which is capable of continuously supplying the fluid at a constant flow rate, and, which is ordinarily a metering pump (not shown). As the metering pump, a variable-flow-rate fluid feed device, e.g., a plunger pump or a gear pump.

A predetermined amount of the coating fluid F supplied to the sump 14 is ejected through the opening of the slit 16, while the remaining amount of the coating fluid F is discharged through the fluid drain 20 to be recovered by the metering fluid feed device. The coating apparatus operates in this manner to prevent the coating fluid F from staying considerably long in the sump 14. This operating method is highly effective with respect to a magnetic coating fluid having thixotropy and easy to coagulate. However, a structure may alternatively be adopted in which the fluid drain 20 is not provided and in which the predetermined amount of the fluid ejected through the opening of the slit 16 is supplied from the fluid supply port 18.

The web W traveling continuously while being supported by travel guide devices such as guide rollers (not shown) is stretched under a substantially constant tension between the travel guide devices which are guide rollers or the like in such a state that it can be slightly curved in its thickness direction, and is moved at a predetermined speed in the direction of the arrow indicated in FIG. 2 while being pressed against the upper surface of the coating head 10 (the surface facing the web W), as shown in FIG. 2. The coating fluid F ejected from the opening of the slit 16 is thereby applied to the predetermined thickness with the flow rate and pressure distribution maintained uniform along the web W width direction.

When the coating fluid F moves apart from the back edge 28, it is at a predetermined distance from the position of intersection between the back edge surface 28*a* and the back edge back surface 28*b*. Therefore, if the portion at this portion is made smooth, more specifically, if the surface roughness Ra is set to 0.2 μm or less, disturbance in the coating film is effectively reduced and substantially no fine equal-pitch streaks are generated.

Figure 4:
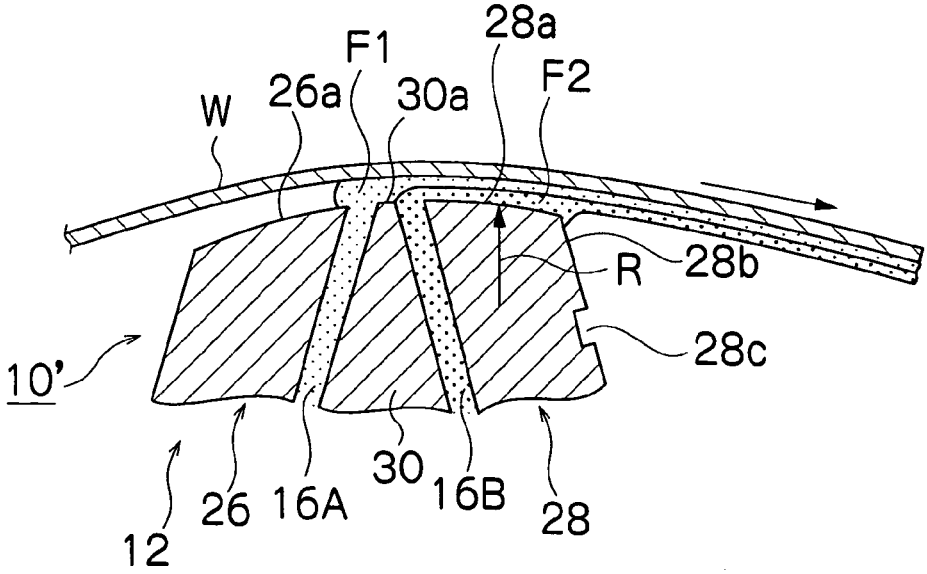
FIG. 4 is a schematic cross-sectional view of another coating head showing the positional relationship between an end portion of the coating head and a flexible supporting member.

Another embodiment of the present invention will be described with reference to FIG. 4. FIG. 4 is a schematic cross-sectional view of a coating head 10' showing the positional relationship between an end portion of the coating head 10' and a flexible supporting member (web) W. Members identical or similar to those in the arrangement shown in FIGS. 1 and 2 are indicated by the same reference characters, and detailed description for them will not be repeated.

As shown in FIG. 4, the coating head 10' is provided with two independent fluid supply systems enabling supply of two coating fluids. That is, the coating head 10' is a so-called "wet on wet" device capable of continuously supplying a first coating fluid F1 and a second coating fluid F2. The coating head 10' differs from the coating head 10 shown in FIGS. 1 and 2 in that slits (16A and 16B) for the first and second coating fluids F1 and F2 are provided.

That is, the slit 16A is formed by a front edge 26 and an intermediate edge 30 of the main body 12 of the coating head 10', while the slit 16B is formed by the intermediate edge 30 and a back edge of the main body 12 of the coating head 10'. In the upper surface of the main body 12 of the coating head 10' (the surface facing the web W), a front edge surface 26*a*, an intermediate edge surface 30*a* and a back edge surface 28*a* is formed in this order from the upstream side.

As shown in FIG. 4, the front edge surface 26*a* is formed so as to be generally straight as viewed in section, the intermediate edge surface 30*a* is formed so as to be short and generally straight as viewed in section, and the back edge surface 28*a* is formed so as to have a circular-arc line having a predetermined radius of curvature R as viewed in section. Also, a predetermined difference in level is provided between the rear-end edge of the front edge surface 26*a* and the front-end edge of the intermediate edge surface 30*a*, and a predetermined difference in level is provided between the rear-end edge of the intermediate edge surface 30*a* and the front-end edge of the back edge surface 28*a*, thereby enabling films of the coating fluids F1 and F2 having predetermined thicknesses to be formed.

Sumps which communicate with the slits 16A and 16B, respectively, are provided. The coating fluids F1 and F2 are supplied to the sumps via fluid supply ports by the metering fluid feed device. Certain amounts of the coating fluids F1 and F2 are ejected through the openings of the slits 16A and 16B, and the remaining amounts of the fluids F1 and F2 are discharged through fluid drains to be recovered by the metering fluid feed device.

Also in the coating head 10' shown in FIG. 4, the web W traveling continuously while being supported by travel guide devices such as guide rollers (not shown) is stretched under a substantially constant tension between the travel guide devices which are guide rollers or the like in such a state that it can be slightly curved in its thickness direction, and is moved at a predetermined speed in the direction of the arrow indicated in FIG. 4 while being pressed against the upper surface of the coating head 10' (the surface facing the web W), as shown in FIG. 4. The coating fluid F1 ejected from the opening of the slit 16A is thereby applied to the predetermined thickness with the flow rate and pressure distribution maintained uniform along the web W width direction. Further, the coating fluid F2 ejected from the opening of the slit 16B is applied in a wet on wet manner to the predetermined thickness with the flow rate and pressure distribution maintained uniform along the web W width direction.

When the coating fluid F2 moves apart from the back edge 28, it is at a predetermined distance from the position of intersection between the back edge surface 28*a* and the back edge back surface 28*b*. Therefore, if the portion at this portion is made smooth, more specifically, if the surface roughness Ra is set to 0.2 μm or less, disturbance in the coating film is effectively reduced and substantially no fine equal-pitch streaks are generated.

While an embodiment of the coating head and the coating apparatus in accordance with the present invention has been described, the present invention can be provided in other various forms without being limited to the described embodiment.

For example, while in the example of the embodiment the sump 14 (each of sumps 14A and 14B) is provided as a cylindrical cavity, the shape of the sump 14 is not limited to such a cylindrical shape and the sump 14 can be provided in any of other various shapes, e.g., a rectangular block shape and a ship bottom shape. No particular restriction is imposed on selection of the shape of the sump 14 if the fluid pressure distribution can be made uniform along the web W width direction.

Figures 5, 6:
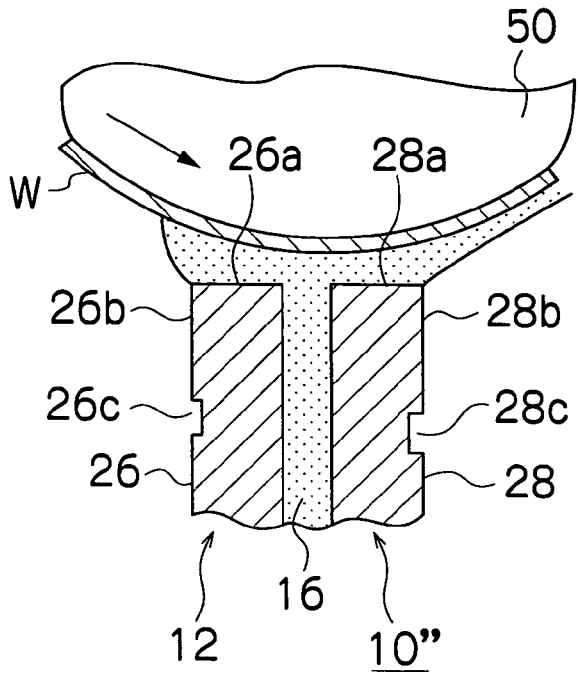
FIG. 5 is a schematic cross-sectional view of another coating head showing the positional relationship between an end portion of the coating head and a flexible supporting member.
FIG. 6 is a table showing the results of Example 1.

Even when an extrusion coating method is used, not an arrangement in which the web W is pressed against the coating head 10 or 10' but an arrangement such as shown in FIG. 5 may be used. In the arrangement shown in FIG. 5, the web W is wrapped around a backup roller 50 and a predetermined clearance is set between the surface of the web W and the end surface of a coating head 10" when coating is performed.

In the coating head 10" shown in FIG. 5, not only a back edge surface 28*a*, a back edge back surface 28*b* and a recess 28*c* but also a front edge back surface 26*b* intersecting a front edge surface 26*a* by forming a predetermined angle at a front edge 26 and, further, a recess 26*c* extending along the web W width direction (the direction of projection of FIG. 5) is formed at a predetermined distance from the intersecting point (edge) at which the front edge back surface 26*b* intersects the front edge surface 26*a*. By the front edge back surface 26*b* thus formed, a certain effect is also obtained, although this effect is lower than that of the back edge back surface 28*b*.

Even in the case of an arrangement in which the recess 28*c* is not formed in the back edge back surface 28*b*, the effect of the present invention can be achieved as described above if the finished state is good, although the degree of difficulty in grinding is increased.

The construction of the coating head 10 (10' or 10") is not limited to the extrusion coating method. The same construction can be adopted in a case where a curtain coating method or the like is used.

EXAMPLES

Examples of the present invention will be described in comparison with comparative examples. In each of examples described below, "parts" denotes "parts by weight". In the examples (Example 1, Example 2) described below, a coating fluid A containing a magnetic material and a coating fluid B not containing the magnetic material are provided in common compositions shown below.

(1) Coating fluid A containing a magnetic material

| | |
|---|---|
| Ferroelectric metal fine powder | 100 parts |
| Composition: Fe/Co = 80/20 | |
| Hc 183 kA/m (2300 Oe) | |
| Specific surface area by BET method 54 $m^2/g$ | |
| Crystal element size 16.5 nm | |
| Surface coating compound $Al_2O_3$ | |
| Particle size (major axis diameter) 0.10 μm | |
| Needle ratio 8 | |
| σs 150 A · $m^2$/kg (emu/g) | |
| Polyvinyl chloride copolymer | 5 parts |
| Product from ZEON Corporation MR-110 | |
| Polyester polyurethane resin | 3 parts |
| Neopentyl glycol/caprolactonepolyol/MDI = 0.9/2.6/1 | |
| Containing —$SO_3Na$ group 1 × 10-4eq/g | |
| α alumina (particle size 0.1 μm) | 5 parts |
| Carbon black (particle size 0.10 μm) | 0.5 parts |
| Butyl stearate | 1.5 part |
| Stearic acid | 0.5 part |
| Methyl ethyl ketone | 90 parts |
| cyclohexane | 30 parts |
| Toluene | 60 parts |

(2) Coating fluid B containing no magnetic material

| | |
|---|---|
| Nonmagnetic powder $\alpha$-$Fe_2O_3$ | 80 parts |
| Average major axis length 0.1 μm | |
| Specific surface area by BET method 48 $m^2/g$ | |
| pH8, $Fe_2O_3$ content 90% or higher | |
| DBP oil absorption 27 to 38 ml/100 g | |
| Surface coating compound $Al_2O_3$ | |
| Carbon black | 20 parts |
| Average primary particle diameter 16 μm | |
| DBP oil absorption 80 ml/100 g | |
| pH8 | |
| Specific surface area by BET method 250 $m^2/g$ | |
| Volatile content 1.5% | |
| Polyvinyl chloride copolymer | 10 parts |
| Product from ZEON Corporation MR-110 | |
| Polyester polyurethane resin | 5 parts |
| Molecular weight 35,000 | |
| Neopentyl glycollcaprolactonepolyol/MDI = 0.9/2.6/1 | |
| Containing —$SO_3Na$ group 1 × 10-4eq/g | |
| Butyl stearate | 1 part |
| Stearic acid | 1 part |
| Methyl ethyl ketone | 100 parts |
| cyclohexane | 50 parts |
| Toluene | 50 parts |

The components of each of the fluids A and B shown above were kneaded by a continuous kneader and were thereafter processed by dispersion processing using a sand mill. The obtained dispersion medium was filtered by using a filter having an average pore diameter of 1 μm, and 100 parts of methyl ethyl ketone was thereafter added to form coating fluids A and B.

Example 1

The coating fluid F prepared as the fluid A was applied to the surface of the web W by using the coating head 10 shown in FIGS. 1 and 2 and the coating film after drying was evaluated. Seven films were made with respect to different states of working on the back edge back surface 28*b* of the coating head 10 and were compared with each other. The surface roughness Ra of the back edge back surface 28*b* was changed in the range from 0.1 to 0.7 μm and the distance L (shown as "smooth portion length" in the table of FIG. 6) was changed in the range from 0.3 to 1.0 mm. The surface roughness Ra of the back edge back surface 28*b* was evaluated with a measuring apparatus manufactured by WYCO Corp. (model name: TOPO-3D).

As the Web W, a 60 μm thick PET (polyethylene terephthalate) member was used. The web W travel speed was set to 200 m/min. The rate of ejection of the coating fluid F was controlled so that the thickness of the layer of the coating fluid F is 5 μm in a wet condition.

The existence/nonexistence of fine equal-pitch streaks (referred to as "fine rib streaks" in the table of FIG. 6) in the specimens after coating was evaluated in a visual organoleptic test. The results of this evaluation are shown in the table of FIG. 6.

Condition 1 in the table relates to a comparative example in which the surface roughness Ra of the back edge back surface 28*b* is 0.7 μm (larger than 0.2 μm) and the smooth portion length is 1.0 mm. Under this condition, fine rib streaks were generated.

Condition 2 in the table relates to a comparative example in which the surface roughness Ra of the back edge back surface 28*b* is 0.4 μm (larger than 0.2 μm) and the smooth portion length is 1.0 mm. Under this condition, fine rib streaks were generated.

In condition 3 in the table, the surface roughness Ra of the back edge back surface 28*b* is 0.2 μm and the smooth portion length is 1.0 mm. Under this condition, substantially no fine rib streaks were generated.

In condition 4 in the table, the surface roughness Ra of the back edge back surface 28*b* is 0.2 μm and the smooth portion length is 0.5 mm. Under this condition, substantially no fine rib streaks were generated.

In condition 5 in the table, the surface roughness Ra of the back edge back surface 28*b* is 0.2 μm and the smooth portion length is 0.3 mm (smaller than the lower limit of a preferable range "0.5 mm or greater"). Under this condition, fine rib streaks were generated.

In condition 6 in the table, the surface roughness Ra of the back edge back surface 28*b* is 0.1 μm and the smooth portion length is 0.5 mm. Under this condition, substantially no fine rib streaks were generated.

In condition 7 in the table, the surface roughness Ra of the back edge back surface 28*b* is 0.1 μm and the smooth portion length is 0.3 mm (smaller than the lower limit of a preferable range "0.5 mm or greater"). Under this condition, fine rib streaks were generated.

From the results shown above, the effect of the present invention was confirmed.

Example 2

The coating fluid F1 prepared as the fluid B was applied to the surface of the web W by using the coating head 10' shown in FIG. 4, and the coating fluid F2 prepared as the fluid A was applied on the undried coating fluid F1, and the coating film after drying was evaluated. Seven films were made with respect to different states of working on the back edge back surface 28*b* of the coating head 10' and were compared with each other. The surface roughness Ra of the back edge back surface 28*b* was changed in the range from 0.1 to 0.7 μm and the distance L (shown as "smooth portion length" in the table of FIG. 7) was changed in the range from 0.3 to 1.0 mm. The surface roughness Ra of the back edge back surface 28*b* was evaluated with a measuring apparatus manufactured by WYCO Corp. (model name: TOPO-3D).

As the Web W, a 6 μm thick PEN (polyethylene naphthalate) member was used. The web travel speed was set to 500 m/min. The rates of ejection of the coating fluids F1 and F2 were controlled so that the thickness of the layer of the coating fluid F1 is 6.0 μm in a wet condition and the thickness of the layer of the coating fluid F2 is 1.2 μm in a wet condition.

The existence/nonexistence of fine equal-pitch streaks (referred to as "fine rib streaks" in the table of FIG. 7) in the specimens after coating was evaluated in a visual organoleptic test. The results of this evaluation are shown in the table of FIG. 7.

Condition 8 in the table relates to a comparative example in which the surface roughness Ra of the back edge back surface 28*b* is 0.7 μm (larger than 0.2 μm) and the smooth portion length is 1.0 mm. Under this condition, fine rib streaks were generated.

Condition 9 in the table relates to a comparative example in which the surface roughness Ra of the back edge back surface 28*b* is 0.4 μm (larger than 0.2 μm) and the smooth portion length is 1.0 mm. Under this condition, fine rib streaks were generated.

In condition 10 in the table, the surface roughness Ra of the back edge back surface 28*b* is 0.2 μm and the smooth portion length is 1.0 mm. Under this condition, substantially no fine rib streaks were generated.

In condition 11 in the table, the surface roughness Ra of the back edge back surface 28*b* is 0.2 μm and the smooth portion length is 0.5 mm. Under this condition, substantially no fine rib streaks were generated.

In condition 12 in the table, the surface roughness Ra of the back edge back surface 28*b* is 0.2 μm and the smooth portion length is 0.3 mm (smaller than the lower limit of a preferable range "0.5 mm or greater"). Under this condition, fine rib streaks were generated.

In condition 13 in the table, the surface roughness Ra of the back edge back surface 28*b* is 0.1 μm and the smooth portion length is 0.5 mm. Under this condition, substantially no fine rib streaks were generated.

In condition 14 in the table, the surface roughness Ra of the back edge back surface 28*b* is 0.1 μm and the smooth portion length is 0.3 mm (smaller than the lower limit of a preferable range "0.5 mm or greater"). Under this condition, fine rib streaks were generated.

From the results shown above, the effect of the present invention was confirmed.

What is claimed is:

1. A coating head for use in a coating apparatus which applies a coating fluid to a surface of a flexible supporting member in a form of a belt traveling continuously, comprising:

a slit facing the supporting member along a width direction of the supporting member, the coating fluid being ejected through an opening of said slit;

a front edge surface provided on an upstream side of said slit in a direction of travel of the supporting member, said front edge surface facing the supporting member;

a back edge surface provided on a downstream side of said slit in the direction of travel of the supporting member, said back edge surface facing the supporting member;

a back edge back surface intersecting said back edge surface by forming a predetermined angle between the back edge back surface and said back edge surface, wherein a surface roughness Ra of said back edge back surface is 0.2 μm or less; and a recess formed in the back edge back surface, said recess extending along the width direction of the supporting member.

wherein a distance between the position at which said back edge back surface intersects said back edge surface and said recess is 0.5 mm or greater.

2. The coating head according to claim 1, wherein each of said back edge surface and said back edge back surface is formed by a sintered hard alloy or a ceramic.

3. The coating head according to claim 1, wherein the back edge back surface extends in a width direction and a depth direction of the supporting member, and the recess is formed so as to create an intermediate gap in the back edge back surface.

4. The coating head according to claim 1, wherein the recess is disposed away from the intersection of the back edge surface and the back edge back surface.

5. A coating head for use in a coating apparatus which applies a coating fluid to a surface of a flexible supporting member in a form of a belt traveling continuously, comprising:

a slit facing the supporting member along a width direction of the supporting member, the coating fluid being ejected through an opening of said slit;

a front edge surface provided on an upstream side of said slit in a direction of travel of the supporting member, said front edge surface facing the supporting member;

a back edge surface provided on a downstream side of said slit in the direction of travel of the supporting member, said back edge surface facing the supporting member;

a back edge back surface intersecting said back edge surface by forming a predetermined angle between the back edge back surface and said back edge surface, wherein a surface roughness Ra of said back edge back surface is 0.2 μm or less, and a recess formed in the back edge back surface, said recess extending along the width direction of the supporting member, wherein the surface roughness Ra of the portion of said back edge back surface between a position at which said back edge back surface intersects said back edge surface and a position at a distance of 0.5 mm from the intersecting position is 0.2 μm or less, and wherein a distance between the position at which said back edge back surface intersects said back edge surface and said recess is 0.5 mm or greater.

* * * * *